US009053920B1

(12) United States Patent
Yeh

(10) Patent No.: US 9,053,920 B1
(45) Date of Patent: Jun. 9, 2015

(54) INTERNAL INDUCTION LAMP WITH PROTECTED MERCURY AMALGAM

(71) Applicant: John Yeh, Chino Hills, CA (US)

(72) Inventor: John Yeh, Chino Hills, CA (US)

( * ) Notice: Subject to any disclaimer, the term of this patent is extended or adjusted under 35 U.S.C. 154(b) by 0 days.

(21) Appl. No.: 14/262,745

(22) Filed: Apr. 26, 2014

(51) Int. Cl.
*H01J 1/50* (2006.01)
*H01J 65/04* (2006.01)
*H01J 61/20* (2006.01)

(52) U.S. Cl.
CPC ..... *H01J 65/048* (2013.01); *H01J 61/20* (2013.01)

(58) Field of Classification Search
CPC ..... H01J 65/048; H01K 11/00
USPC ..... 313/153, 154, 155, 156
See application file for complete search history.

(56) References Cited

U.S. PATENT DOCUMENTS

2003/0132706 A1 * 7/2003 Itaya et al. ..... 313/573

* cited by examiner

*Primary Examiner* — Vip Patel
(74) *Attorney, Agent, or Firm* — Denis Khoo

(57) ABSTRACT

An internal induction lamp with a glass envelope bulb assembly and an inductor shaft assembly. The glass envelope bulb assembly is a hollow glass envelope bulb with a mercury amalgam stem protruding downwards from the bottom of the hollow glass envelope bulb. The mercury amalgam stem is fragile, and protected by a stem protector. The inductor shaft assembly, which inserts into the glass envelope bulb assembly accommodates the protrusion of the mercury amalgam stem along with the stem protector. The inductor shaft assembly and envelope bulb assembly may attach via a threaded ring connector. The inductor shaft assembly may have a heat sink, and a gap within the heat sink to accommodate placement of the stem protector within this gap.

6 Claims, 5 Drawing Sheets

INTERNAL INDUCTION LAMP WITH PROTECTED MERCURY AMALGAM

DESCRIPTION OF RELATED ART

Induction lamps have many advantages over other conventional lamps. The primary difference between an induction lamp and a conventional lamp is that an induction lamp is electrode-less. Being electrode-less, induction lamps enjoy a longer life than conventional lamps that are dependent on an electrode. Generally, electrodes fail in normal lamps, such as normal fluorescent lamps, shortening their life. In addition, induction lamps have a sealed tube due to not having electrodes. As the tube can be perfectly sealed, induction lamps may also experience a longer life than conventional lamps because the gas cannot escape through worn out seals. Induction lamps are also very energy efficient, do not exhibit flickering, and are dimmable.

Two types of induction lamps are external induction lamp and internal induction lamp. An external induction lamp has an induction coil mounted outside of the bulb or tube. The induction coil is generally covered by a metal sheath and is highly visible. A powerful magnetic field is created when high frequency energy is sent from the ballast to the electromagnet. The powerful magnetic field excites the nearby mercury amalgam, causing the mercury to take on its vapor form and spreading throughout the tube. As such, it is important that the induction coil's magnetic field and mercury amalgam be in close enough proximity for this reaction to occur. It is also important that the induction coil's magnetic field be in close enough proximity to the mercury vapor in its excited state within the lamp bulb. Just as in a standard fluorescent lamp, the mercury vapor creates UV and this is converted into visible light via the phosphor.

An internal induction lamp works on the same principle as an external induction lamp, except that the electromagnet is placed inside of the glass bulb. FIG. 1 shows an example of the prior art. The glass envelope bulb 110 is hollow on the inside, except for the stem 130 containing the mercury amalgam (at the base of the stem). The stem is open to the glass envelope of the bulb which allows the mercury amalgam vapor to be spread throughout the glass envelope when in use. The hollow nature of the glass envelope bulb 110 accommodates the insertion of the inductor shaft 120. In FIG. 1, the inductor shaft 120 has a hollow center to accommodate the mercury amalgam stem 130. The stem 130 is prone to breakage when the inductor shaft 120 is installed onto the glass envelope bulb 110. There is a need for an improved internal induction lamp design that is less prone to breakage when the inductor shaft is installed.

BRIEF SUMMARY OF THE INVENTION

In a preferred embodiment, an internal induction lamp has a mercury amalgam stem that is surrounded by a stem protector. This reduces physical exposure of the mercury amalgam stem and thus aids in preventing the stem from being accidentally hit and broken. The inductor shaft assembly may accommodate the position and protrusion of the stem protector through a gap in the heat sink. The stem protector may further be shaped in such a fashion to mimic the appearance of the heat sink for improved aesthetics.

BRIEF DESCRIPTION OF THE DRAWINGS

A more complete appreciation of the invention and many of the advantages thereof will be readily obtained as the same becomes better understood by reference to the detailed description when considered in connection with the accompanying drawings, wherein.

DETAILED DESCRIPTION

Figure 1:
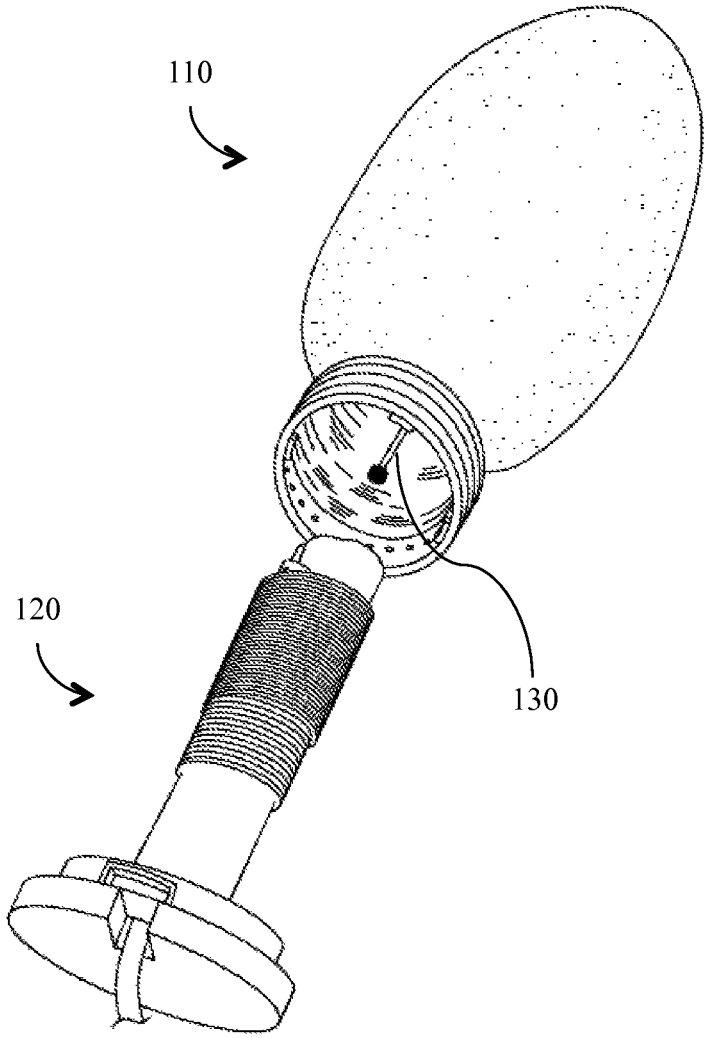
FIG. 1 (Prior Art)
FIG. 1 is a perspective view of the prior art.
Figure 2:
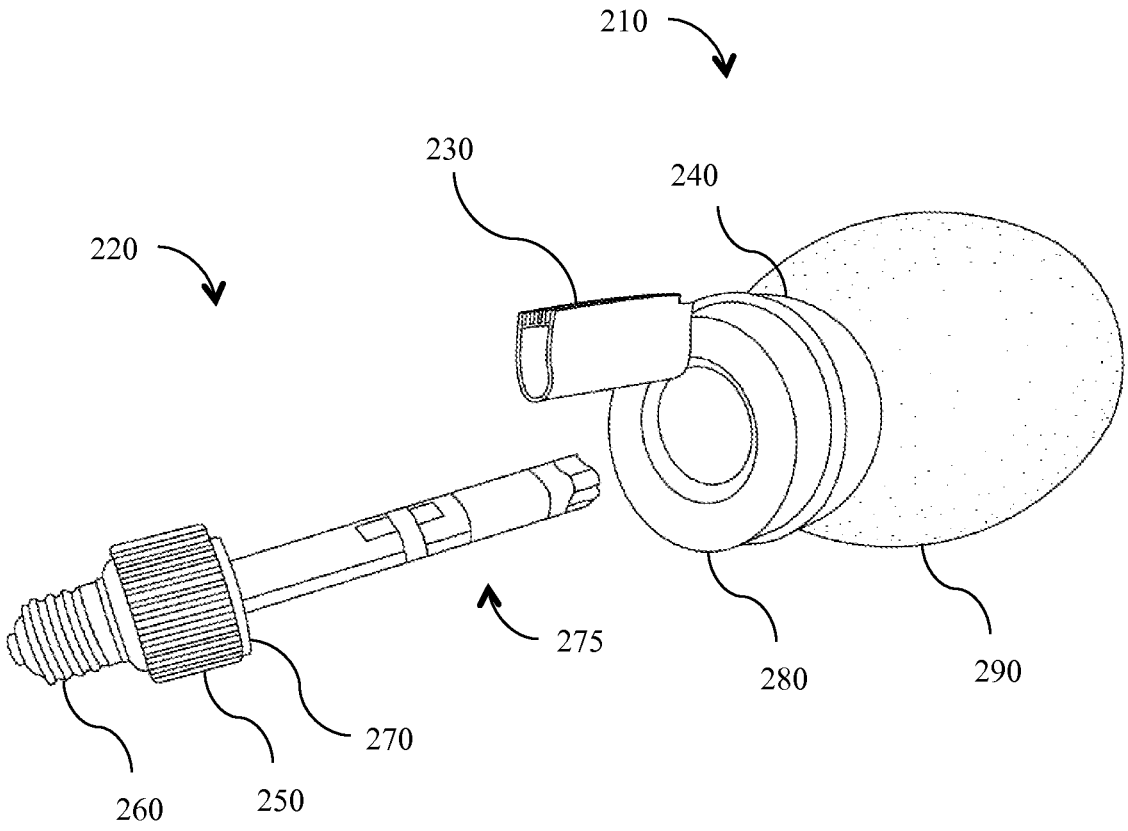
FIG. 2 is a perspective view of an embodiment of an internal induction lamp with the induction coil removed from the glass envelope bulb.

In FIG. 2, a preferred embodiment of an improved internal induction lamp is shown. The glass envelope bulb assembly 210 is shown with the inductor shaft assembly 220 removed. Please note that FIG. 2 is not drawn to scale. In particular, the inductor shaft assembly 220 is shown further away than the glass envelope bulb assembly 210. The glass envelope bulb assembly 210, unlike the prior art, does not have a stem down the center. The glass envelope bulb assembly 210 is comprised of a glass envelope bulb 290, a base 280, a connector ring with a female thread 240, a mercury amalgam stem, and a stem protector 230.

Figure 3:
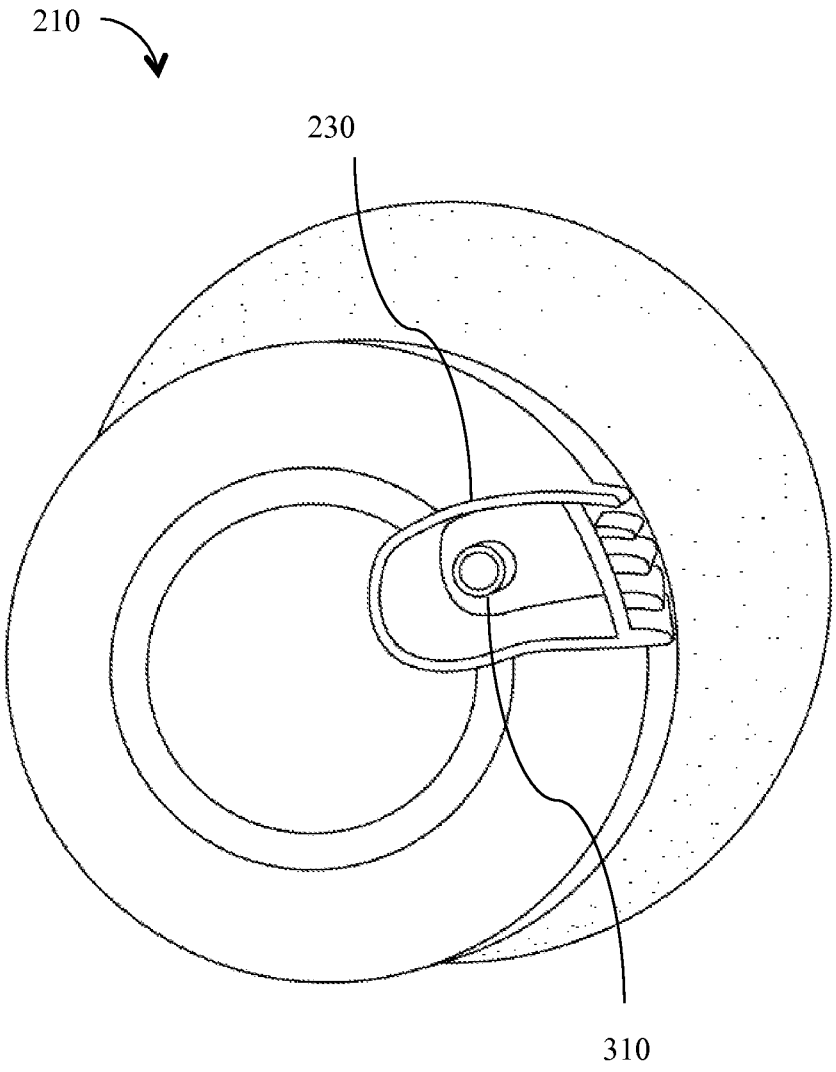
FIG. 3 is a bottom view of an embodiment of the glass envelope bulb.

FIG. 3 shows a bottom view of the glass envelope bulb assembly. The mercury amalgam stem 310 can be seen from this perspective. As seen, the mercury amalgam stem 310 still protrudes downward with respect to the glass envelope bulb assembly 210, but rather than having a very long stem that goes down the center, the stem protrudes from the bottom of the hollow glass envelope. The mercury amalgam stem 310 generally has mercury amalgam at the base of the stem when the bulb is not in use. It is normal for mercury when it cools from a vapor form to escape to the coolest part of the bulb, which in this case is the base of the stem 310. As would be expected, the stem is open to the glass envelope 290, so that the mercury vapor can spread throughout the glass envelope when the bulb is turned on.

Figure 4:
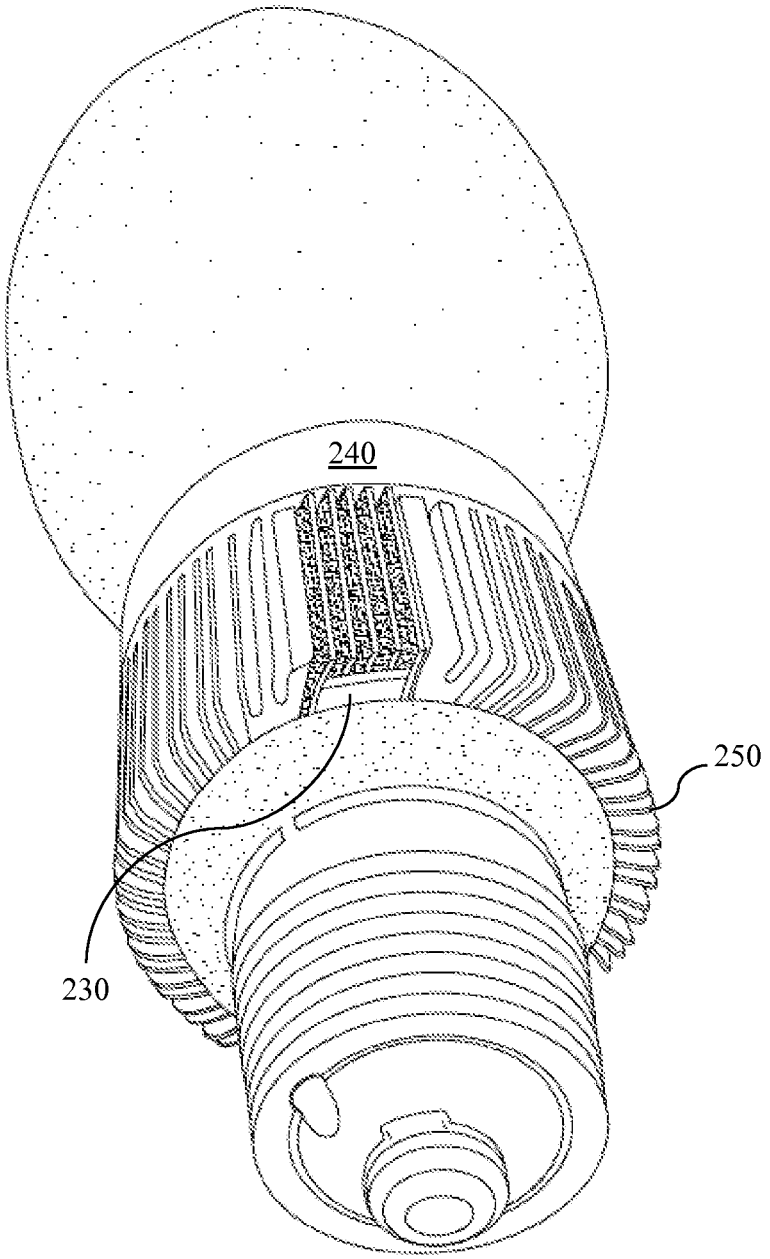
FIG. 4 is a bottom perspective view of an embodiment of an internal induction lamp.
Figure 5:
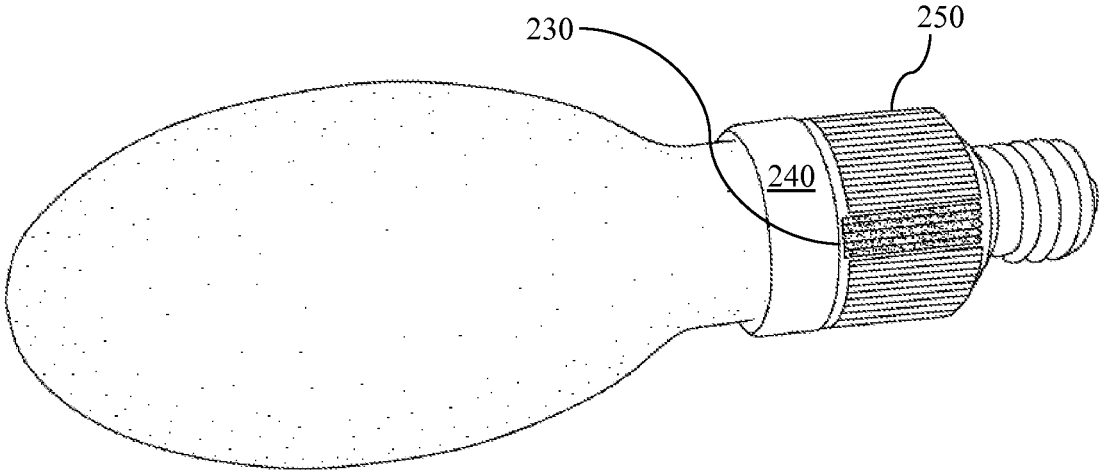
FIG. 5 is a side view of an embodiment of an internal induction lamp.

The stem protector 230 protects the stem 310, and helps prevent it from being inadvertently hit and broken by the inductor shaft assembly or something else. In order to effectively provide protection, the stem protector 230 protrudes further out than the stem 310. In this embodiment, the bottom of the stem protector is open at the bottom, but in other embodiments, this may be closed off to further protect the stem from any exposure. The stem protector 230 may be shaped for both form and functionality. FIGS. 4 and 5 show how the stem protector 230 appears when the inductor shaft assembly 220 is installed onto the glass envelope bulb assembly 210.

The base 280 is generally constructed of a plastic material, and is attached to the glass envelope bulb 290 to protect the glass envelope bulb and make it more convenient to attach the inductor shaft assembly 220 into the glass envelope bulb assembly 210. When the inductor shaft assembly 220 is attached to the glass envelope bulb 290, The connector ring 240 can spin freely on the base 280, and is held into the base 280 such that it cannot be removed, and serves to secure the inductor shaft assembly 220 to the glass envelope bulb assembly 210. This works in a similar fashion to a compression fitting. The inductor shaft assembly 220 has male thread 270, which secures to the female thread of the connector ring 240. FIGS. 4 and 5 show the inductor shaft assembly inserted into the glass envelope bulb, with the connector ring 240 securing the two parts together. When the connector ring 240 is tightened over the male thread 270, the connector ring 240 catches at the back side of the connector ring to the base 280, causing the inductor shaft assembly 220 to squeeze against the base 280 as the connector ring 240 is tightened.

The inductor shaft assembly 220 can be seen in FIG. 2. In the preferred embodiment, the inductor shaft assembly 220 is comprised of the inductor shaft 275, male thread 270, heat sink 250 and screw base 260. In other embodiments, the electrical connection may be something other than a screw base 260 as is well known to those skilled in the art. The heat sink 250 has a gap (not shown in FIG. 2) specifically to accommodate the stem protector 230 when attaching the inductor shaft assembly 220 to the glass envelope bulb assembly 210. FIGS. 4 and 5 show the stem protector 230 filling the gap in the heat sink 250. In the preferred embodiment, the stem protector's visible parts (after the inductor shaft assembly is installed onto the glass envelope bulb) has the shape and appearance of the heat sink to be more aesthetically pleasing. In the preferred embodiment, the stem protector 230 is made of the same material as the base 280 of the glass envelope bulb assembly 210. This allows the stem protector 230 to be molded as part of the base 280, thus lowering cost of manufacturing.

This design results in a number of significant advantages. First is the advantage of the stem 310 being well protected. Second is that the stem is exposed to less heat than would be in the prior art. Third is a fully integrated design that serves both form and function.

The present invention has been described in an illustrative manner. It is to be understood that the terminology which has been used is intended to be in the nature of words of description rather than of limitation. While there have been described herein, what are considered to be preferred and exemplary embodiments of the present invention, other modifications of the invention shall be apparent to those skilled in the art from the teachings herein and, it is, therefore, desired to be secured in the appended claims all such modifications as fall within the true spirit and scope of the invention.

What is claimed is:

1. An internal induction lamp comprising:

a glass envelope bulb assembly, comprising of a) a hollow glass envelope bulb, b) a mercury amalgam stem attached to the bottom of said hollow glass envelope bulb, and c) a stem protector protecting said mercury amalgam stem; and an inductor shaft assembly inserted into said glass envelope bulb assembly and said inductor shaft assembly forming a magnetic field to excite mercury in said mercury amalgam stem, whereby said glass envelope bulb assembly lights up.

2. The internal induction lamp of claim 1, wherein said glass envelope bulb assembly further comprises of a base with a threaded cover ring, and said inductor shaft assembly is comprised of a threaded portion, such that said threaded cover ring attaches and tightens over said threaded portion of inductor shaft assembly.

3. The internal induction lamp of claim 2, wherein said inductor shaft assembly is further comprised of a heat sink portion, wherein said heat sink portion has a gap for said stem protector to fit within when said inductor shaft assembly is inserted into said glass envelope bulb assembly.

4. The internal induction lamp of claim 3, wherein said inductor shaft assembly is further comprised of a screw base electrical connection at the bottom.

5. The internal induction lamp of claim 4, wherein said stem protector surrounds said mercury amalgam stem around the sides and bottom.

6. The internal induction lamp of claim 5 wherein said base and said stem protector are comprised of a plastic material.

* * * * *